US007112045B2

(12) United States Patent
Kimura et al.

(10) Patent No.: US 7,112,045 B2
(45) Date of Patent: Sep. 26, 2006

(54) ELECTRIC COMPRESSOR

(75) Inventors: Kazuya Kimura, Kariya (JP); Ken Suitou, Kariya (JP); Hiroyuki Gennami, Kariya (JP); Kazuhiro Kuroki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 478 days.

(21) Appl. No.: 10/618,945

(22) Filed: Jul. 14, 2003

(65) Prior Publication Data

US 2004/0013543 A1 Jan. 22, 2004

(30) Foreign Application Priority Data

Jul. 15, 2002 (JP) ..... 2002-205273

(51) Int. Cl.
*F04B 17/03* (2006.01)
*H02K 9/12* (2006.01)

(52) U.S. Cl. ..... 417/371; 310/52

(58) Field of Classification Search ..... 417/410.1, 417/423.14, 371; 310/52
See application file for complete search history.

(56) References Cited

U.S. PATENT DOCUMENTS

| | | | | |
|---|---|---|---|---|
| 5,904,471 | A | 5/1999 | Woollenweber et al. | |
| 6,041,609 | A | 3/2000 | Hornsleth et al. | |
| 6,107,716 | A | 8/2000 | Penketh | |
| 6,132,184 | A * | 10/2000 | Robertson et al. | 417/410.3 |
| 6,135,726 | A * | 10/2000 | Robertson et al. | 417/360 |
| 6,198,183 | B1 * | 3/2001 | Baeumel et al. | 310/52 |
| 6,737,579 | B1 * | 5/2004 | Laufer et al. | 174/50.52 |
| 2003/0143090 | A1 * | 7/2003 | Iritani et al. | 417/410.5 |
| 2005/0063836 | A1 * | 3/2005 | Kimura et al. | 417/423.14 |

FOREIGN PATENT DOCUMENTS

| | | |
|---|---|---|
| DE | 4418271 | 11/1995 |
| DE | 19859340 | 7/2000 |
| EP | 1209362 | 5/2002 |
| JP | 6212471 | 1/1987 |
| JP | 6219535 | 2/1987 |
| JP | 4080554 | 3/1992 |

* cited by examiner

*Primary Examiner*—Michael Koczo, Jr.
(74) *Attorney, Agent, or Firm*—Knoble Yoshida& Dunleavy,LLC

(57) ABSTRACT

An electric compressor has a compressor housing, a compression mechanism, an electric motor, an accommodating portion and a motor drive circuit. The compressor housing has a circumferential wall and a central axis. The compression mechanism is arranged in the compressor housing for compressing fluid. The electric motor is operatively connected to the compression mechanism for driving the compression mechanism. The accommodating portion is provided on an outer surface of the compressor housing and defines an accommodating space. The inner surface of the accommodating space includes a bottom surface and a side surface. The bottom surface is defined as a radially inward surface of the inner surface relative to the central axis. The side surface surrounds a periphery of the bottom surface. The bottom and side surfaces are defined by the compressor housing. The motor drive circuit is arranged in the accommodating space for driving the electric motor.

19 Claims, 4 Drawing Sheets

ELECTRIC COMPRESSOR

BACKGROUND OF THE INVENTION

The present invention relates to an electric compressor including a compression mechanism that is driven by an electric motor.

For example, a conventional electric compressor is shown in FIG. 5, a diagram illustrates a front end view of a motor compressor or an electric compressor 100 according to a prior art. A compressor housing 101 forms an outer shell of the motor compressor 100. An electric motor 102 and a compression mechanism 103 are accommodated in the compressor housing 101. The compressor housing 101 includes a substantially cylindrical circumferential wall 101*a* around a central axis L of the motor compressor 100, and a motor drive circuit 104 is arranged on the circumferential wall 101*a*. The motor drive circuit 104 includes an inverter and the like for driving the electric motor 102. The motor drive circuit 104 mounted on the circumferential wall 101*a* in a state where the motor drive circuit 104 is accommodated in a casing 106.

An unwanted feature is that the casing 106 for accommodating the motor drive circuit 104 is independent to the compressor housing 101 in the motor compressor 100. As a result, the number of components of the motor compressor 100 increases so that the assembly of the compressor is complicated.

Additionally, the circumferential wall 101*a* forms substantially cylindrical in shape, while the casing 106 forms cubic in shape. Since the circumferential wall 101*a* is different in shape than the casing 106, the casing 106 largely protrudes from the compressor housing 101 in the transverse direction. Accordingly, the motor compressor 100 becomes undesirably large in size. Therefore, there is a need for an electric compressor that reduces the number of components and that efficiently becomes compact.

SUMMARY OF THE INVENTION

In accordance with the present invention, an electric compressor has a compressor housing, a compression mechanism, an electric motor, an accommodating portion and a motor drive circuit. The compressor housing has a circumferential wall and a central axis and side walls projected from the circumferential wall. The compression mechanism is arranged in the compressor housing for compressing fluid. The electric motor is operatively connected to the compression mechanism for driving the compression mechanism. The accommodating portion is integrally formed on an outer surface of the compressor housing at least partially with the projected side walls and defines an accommodating space. The inner surface of the accommodating space includes a bottom surface and a side surface. The bottom surface is defined as a radially inward surface of the inner surface proximal to the central axis. The side surface surrounds a periphery of the bottom surface. The motor drive circuit is arranged in the accommodating space for driving the electric motor.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment of the present invention will now be described in reference to FIGS. 1 through 3.

Figure 1:
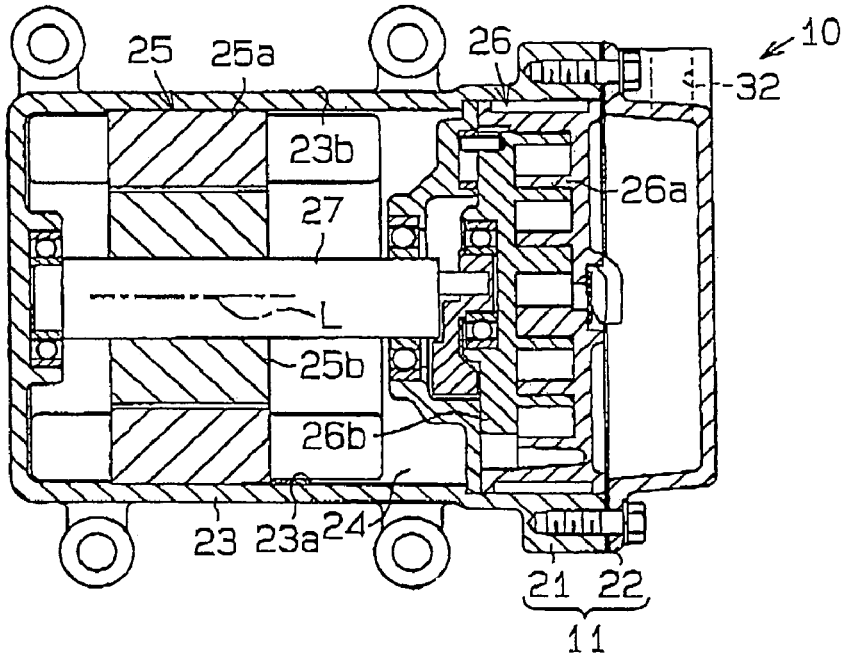
FIG. 1 is a longitudinal cross-sectional view of a motor compressor according to a preferred embodiment of the present invention.

Now referring to FIG. 1, a diagram illustrates a longitudinal cross-sectional view of a motor compressor or an electric compressor 10 according to the preferred embodiment of the present invention. A compressor housing 11 forms an outer shell of the motor compressor 10 and includes a first housing element 21 and a second housing element 22. The first housing element 21 has a substantially cylindrical circumferential wall 23 and an end wall that is formed on the left end of the circumferential wall 23 in the drawing. The first housing element 21 is die-cast in an aluminum alloy. The second housing element 22 forms a cylinder with an end wall on the right end in the drawing and is die-cast in an aluminum alloy. The first and second housing elements 21, 22 are fixedly connected with each other so that a closed space 24 is defined in the compressor housing 11.

A rotary shaft 27 is rotatably supported by the first housing element 21 in the closed space 24 and has a central axis of rotation that is identical to the central axis L of the motor compressor 10. The circumferential wall 23 of the first housing element 21 surrounds the central axis L of the motor compressor 10.

An electric motor 25 and a compression mechanism 26 are accommodated in the closed space 24. The electric motor 25 is a brushless direct current (DC) type and includes a stator 25*a* and a rotor 25*b*. The stator 25*a* is fixedly connected to an inner surface 23*a* of the circumferential wall 23 of the first housing element 21. The rotor 25*b* is provided on the rotary shaft 27 and is arranged inside the stator 25*a*. The electric motor 25 rotates the rotary shaft by electric power that is supplied to the stator 25*a*.

The compression mechanism 26 is a scroll type and includes a fixed scroll member 26*a* and a movable scroll member 26*b*. As the movable scroll member 26*b* orbits relative to the fixed scroll member 26*a* in accordance with the rotation of the rotary shaft 27, the compression mechanism 26 compresses refrigerant gas or fluid. An outlet 32 is formed in the second housing element 22 for discharging the compressed refrigerant gas to an external refrigerant circuit, which is not shown in the drawing.

As the electric motor 25 drives the compression mechanism 26, the refrigerant gas in relatively low temperature and relatively low pressure is introduced from the external refrigerant circuit into the compression mechanism 26 through the electric motor 25. The introduced refrigerant gas is compressed to have relatively high temperature and relatively high pressure by the compression mechanism 26. Then, the refrigerant gas is discharged to the external refrigerant circuit through the outlet 32. Incidentally, the refrigerant gas in relatively low temperature from the external refrigerant circuit cools the electric motor 25 as it passes by the electric motor 25.

Figure 2:
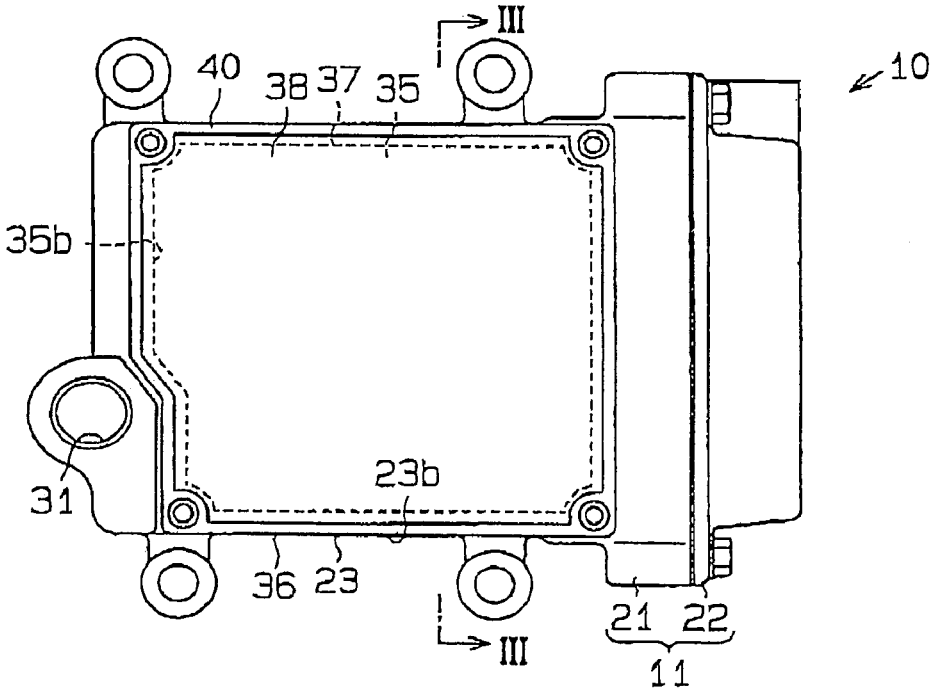
FIG. 2 is a side view of the motor compressor according to the preferred embodiment of the present invention.

Now referring to FIG. 2, a diagram illustrates a side view of the motor compressor 10 according to the preferred embodiment of the present invention. An inlet 31 is formed in the first housing element 21. The refrigerant gas is introduced from the external refrigerant circuit into the compressor housing 11 through the inlet 31.

Figure 3:
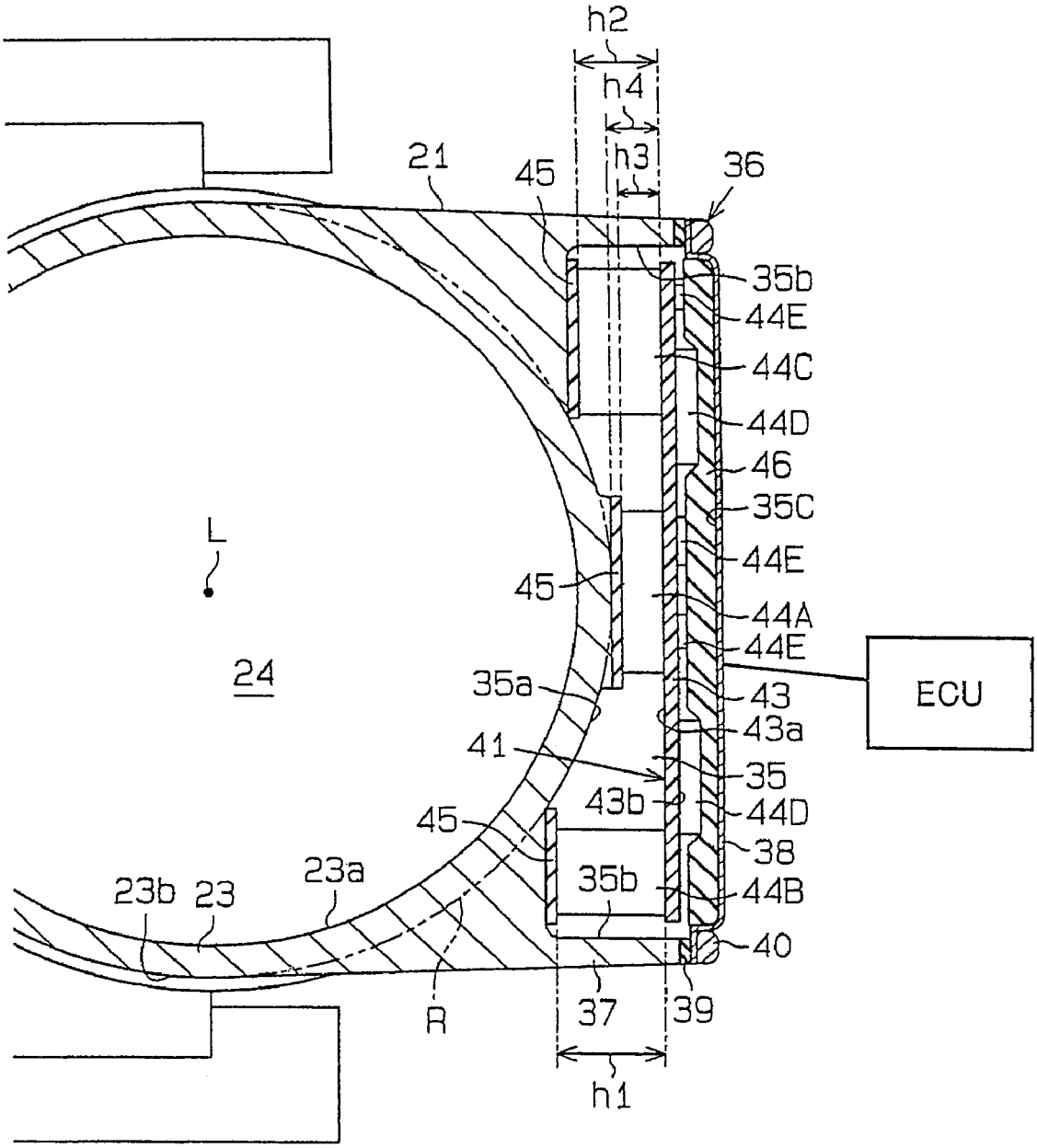
FIG. 3 is a partially enlarged cross-sectional view that is taken along the line III—III in FIG. 2 in a state when an electric motor is detached.

Now referring to FIG. 3, a diagram illustrates a partially enlarged cross-sectional view that is taken along line III—III in FIG. 2. An outer surface 23*b* of the circumferential wall 23 is mostly formed along a cylindrical surface R having the central axis L. The first housing element 21 partially includes an accommodating portion 36. The accommodating portion 36 is provided on a portion of the outer surface 23*b* of the circumferential wall 23 and defines an accommodating space 35 inside. The accommodating portion 36 includes a frame-shaped side wall 37 and a cover member 38.

The side wall 37 is integrally formed with the circumferential wall 23 and extends from the outer surface 23*b*. The cover member 38 is fixedly connected to the distal end surface of the side wall 37 by a fixing frame 40. In other words, the cover member 38 covers the opening of the side wall 37. The cover member 38 forms a thin plate and is made of metal such as an aluminum alloy. A seal member 39 is interposed between the distal end surface of the side wall 37 and the outer peripheral portion of the cover member 38 for sealing the accommodating space 35.

The outer surface 23*b* of the circumferential wall 23 defines a bottom surface 35*a* of the accommodating space 35. In other words, the bottom surface 35*a* corresponds to a surface on the near side relative to the central axis L, that is, a radially inward surface of the compressor housing 11 relative to the central axis L, among inner surfaces of the accommodating space 35. The inner surface of the side wall 37 substantially defines a side surface 35*b* of the accommodating space 35. Namely, the first housing element 21 substantially defines the bottom and side surfaces 35*a*, 35*b* of the accommodating space 35. That is, the inner surface of the accommodating space 35 includes the bottom and side surfaces 35*a*, 35*b*. The side surface 35*b* surrounds the periphery of the bottom surface 35*a*. The cover member 38 defines a top surface 35*c* of the accommodating space 35. In other words, the top surface 35*c* is formed by the cover member 38. Incidentally, the side wall 37 does not completely surround the side of a motor drive circuit 41.

The motor drive circuit 41 is accommodated in the accommodating space 35 in the accommodating portion 36 for driving the electric motor 25. The motor drive circuit 41 includes an inverter and supplies the stator 25*a* of the electric motor 25 with electric power based on a command from an air conditioner ECU, which is not shown in the drawing. Incidentally, the refrigerant gas cools the motor drive circuit 41 as it is introduced from the external refrigerant circuit to the compression mechanism 26 through the electric motor 25.

The motor drive circuit 41 includes a planar substrate 43 and a plurality of electrical components. The substrate 43 is fixedly connected to the circumferential wall 23 by a fastener, such as a bolt, which is not shown in the drawing. The substrate 43 is substantially in parallel with the central axis L of the motor compressor 10. The electrical components are respectively mounted on surfaces 43*a*, 43*b* of the substrate 43. Namely, the electrical components are respectively mounted on the substrate 43 on the near and far sides relative to the central axis L. Incidentally, the electrical components include electrical components 44A through 44E and other electrical components, which are not shown in the drawing.

The electrical components include known components for constituting the inverter. That is, the electrical components include a switching device 44A, an electrolytic condenser 44B, a transformer 44C, a driver 44D, a fixed resistance and the like. The driver 44D is an integrated circuit chip or an IC chip for intermittently controlling the switching device 44A based on a command from the air conditioner ECU.

The switching device 44A has a height of h3 from the substrate 43 and is mounted on the surface 43*a* of the substrate 43, that is, on the substrate 43 on the near side relative to the central axis L. Some of the electrical components are shorter than the switching device 44A if they are mounted on the same surface. Only the above shorter electrical components are mounted on the surface 43*b* of the substrate 43, that is, on the substrate 43 on the far side relative to the central axis L. The above shorter electrical components 44 include the driver 44D and the fixed resistance 44E.

Some of the electrical components have a height of h1 and h2 from the substrate 43 and are taller than the switching device 44A. The taller electrical components 44B and 44C and the switching device 44A are mounted on the surface 43*a* of the substrate 43, that is, on the substrate 43 on the near side relative to the central axis L. The taller electrical components include the electrolytic condenser 44B and the transformer 44C. Accordingly, among the electrical components on the surface 43*a* of the substrate 43, the switching device 44A corresponds to a short electrical component that has a relatively short height of h3 from the substrate 43, and the electrolytic condenser 44B and the transformer 44C correspond to tall electrical components that have relatively tall heights of h1, h2.

In the preferred embodiment, the electrical components on the surface 43*a* are arranged as follows. The short electrical components such as the switching device 44A are arranged at the middle portion of the surface 43*a* of the substrate 43. The tall electrical components such as the electrolytic condenser 44B and the transformer 44C are arranged at both ends of the surface 43*a*, that is, the upper and lower ends of the surface 43*a* in FIG. 3. Namely, the short electrical components are arranged relatively closer to the central axis L, while the tall electrical components are arranged relatively farther from the central axis L. As arranged above, the motor drive circuit 41 is installed to the compressor housing 11 in such a manner that the electrical components on the surface 43*a* of the substrate 43 line the cylindrical surface R of the circumferential wall 23. Incidentally, the switching device 44A, the electrolytic condenser 44B and the transformer 44C each are plurally arranged in the direction of the central axis L.

A clearance between the bottom surface 35*a* and the top surface 35*c* is relatively narrow at the middle region of the accommodating space 35 in the accommodating portion 36, and the short electrical components such as the switching device 44A are arranged at the middle region of the accommodating space 35. Clearances between the bottom surface 35*a* and the top surface 35*c* are relatively wide at both end regions relative to the middle region of the accommodating space 35, and the tall electrical components such as the electrolytic condenser 44B and the transformer 44C are arranged at the above end regions. Namely, the bottom surface 35*a* of the accommodating space 35 includes a convex surface at its middle where the bottom surface 35*a* approaches the top surface 35*c* to the maximum. Accordingly, in comparison to an accommodating space that includes an entire planar bottom surface, the accommodating space 35 partially forms the shape along the cylindrical surface R of the circumferential wall 23.

In the motor drive circuit 41 in the accommodating space 35, the electrical components are arranged on the surface 43*a* of the substrate 43 along the cylindrical surface R of the circumferential wall 23. Therefore, the motor drive circuit 41 is arranged to approach the central axis L of the motor compressor 10 because the electrical components line the cylindrical surface R of the circumferential wall 23.

The substrate 43 is arranged at a distance of h4 from the cylindrical surface R. The distance h4 is shorter than the height h1 of the electrolytic condenser 44B that is the tallest in the electrical components. The cylindrical surface R of the circumferential wall 23 approaches the surface 43*a* of the substrate 43 without any interference with the electrical components on the surface 43*a*, that is, without crossing the electrical components on the surface 43*a*. Namely, the motor drive circuit 41 is arranged near the central axis L of the motor compressor 10 so that the cylindrical surface R of the circumferential wall 23 is arranged at the distance h4 from the substrate 43 and the distance h4 is shorter than the height h1 of the electrolytic condenser 44B.

In the preferred embodiment, "the electrical components line the cylindrical surface R of the circumferential wall 23" means a state where the the cylindrical surface R of the circumferential wall 23 approaches the surface 43*a* in such a manner that the distance h4 from the substrate 43 at least becomes shorter than the height h1 of the electrolytic condenser 44B while the cylindrical surface R of the circumferential wall 23 does not interfere with the electrical components on the surface 43*a*.

Particularly, in the preferred embodiment, the cylindrical surface R of the circumferential wall 23 approaches the surface 43*a* of the substrate 43 in such a manner that the distance h4 from the substrate 43 becomes shorter than the height h2 of the transformer 44C, which is the second tallest, and the cylindrical surface R does not interfere with the electrical components on the surface 43*a*. Accordingly, the electrical components on the surface 43*a* adjacently line the cylindrical surface R of the circumferential wall 23 so that the motor drive circuit 41 is arranged near the central axis L much closer.

In the motor drive circuit 41, the switching device 44A, the electrolytic condenser 44B and the transformer 44C are in contact with the bottom surface 35*a* of the accommodating space 35 through a sheet or a first insulating member 45 made of rubber or resin. Namely, the sheet 45 respectively is interposed between the electrical components 44A, 44B, 44C and the first housing element 21 made of aluminum. A material having properties of relatively high elasticity and/or relatively high heat conductivity is employed as the sheet 45. A clearance between the top surface 35*c* of the cover member 38 and the motor drive circuit 41 is filled with a filler or a second insulating member 46 made of rubber or resin. The filler 46 has properties of relatively high elasticity and/or relatively high heat conductivity.

According to the preferred embodiment, the following advantageous effects are obtained.

Figure 5:
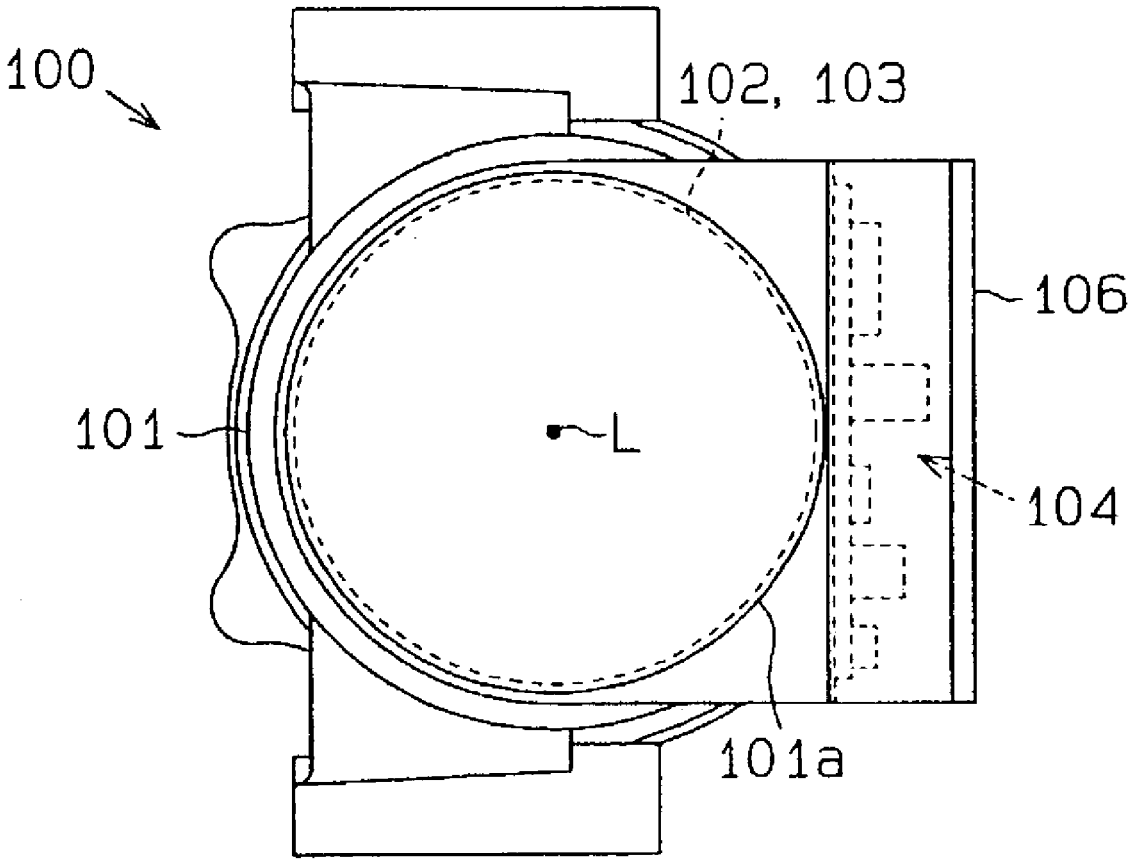
FIG. 5 (PRIOR ART)
FIG. 5 is a front end view of a motor compressor according to a prior art.

(1) In the accommodating portion 36, the compressor housing 11 defines the bottom and side surfaces 35*a*, 35*b* of the accommodating space 35. Accordingly, in comparison to an accommodating portion that is independent to the compressor housing 11, for example, the casing 106 illustrated in FIG. 5, the number of components is reduced in the motor compressor 10. Additionally, the compressor housing 11 having relatively high rigidity surrounds the motor drive circuit 41 and effectively protects the motor drive circuit 41 against an impact from the outside. Additionally, the compressor housing 11 partially includes the accommodating portion 36 so that the protrusion of the accommodating portion 36 from the compressor housing 11 in the direction perpendicular to the central axis L is controlled at a relatively small amount. Thus, the motor compressor 10 becomes compact. Furthermore, the side wall 37 of the compressor housing 11 having relatively high rigidity surrounds the side of the motor drive circuit 41 so that it effectively protects the motor drive circuit 41 against an impact from the outside.

(2) On the substrate 43 on the near side relative to the central axis L, the electrical components 44A through 44C are in contact with the bottom surface 35*a* of the accommodating space 35 through the insulative sheet 45. In comparison to a state when an insulating space or a relatively large space is defined between the electrical components 44A through 44C and the bottom surface 35*a* of the accommodating space 35, the motor drive circuit 41 is arranged closer to the central axis L in the preferred embodiment. Accordingly, the motor compressor 10 is further reduced in size. Additionally, in comparison to a state when an insulating space is defined, heat generated from the electrical components 44A through 44C is efficiently conducted to the compressor housing 11 so that the motor drive circuit 41 is efficiently cooled.

Furthermore, when the sheet 45 employs a material having relatively high heat conductivity, it contributes to further efficiently cooling the motor drive circuit 41. Meanwhile, when the sheet 45 employs a material having relatively high elasticity, it contributes to protecting the motor drive circuit 41 against an impact from the outside. In addition, the sheet 45 elastically deforms to cancel a dimensional tolerance so that the electrical components 44A through 44C are in firmly contact with the bottom surface 35*a* of the accommodating space 35. This leads to improvement in heat radiation performance of the electrical components 44A through 44C to the compressor housing 11.

(3) The metal cover member 38 is fastened to the compressor housing 11 for defining the top surface 35*c* of the accommodating space 35. The insulative filler 46 is interposed between the top surface 35*c* and the motor drive circuit 41. The combination of the metal cover member 38 and the metal compressor housing 11 surrounds the motor drive circuit 41. Accordingly, electromagnetic wave generated by the motor drive circuit 41 is prevented from leaking outside for efficiently suppressing noise toward the other electrical components.

Furthermore, in comparison to an insulating space or a large space is defined between the motor drive circuit 41 and the top surface 35*c* of the accommodating space 35, the filler 46 is interposed between the motor drive circuit 41 and the top surface 35*c* of the accommodating space 35 so that the top surface 35*c* is arranged relatively close to the central axis L, that is, the cover member 38 is arranged relatively close to the central axis L. Accordingly, the motor compressor 10 is further reduced in size. Also, in comparison to a state when an insulating space is defined, heat generated by the motor drive circuit 41 is efficiently conducted through the cover member 38 so that the motor drive circuit 41 is efficiently cooled.

When the filler 46 employs a material having relatively high heat conductivity, it contributes to further efficiently cooling the motor drive circuit 41. Meanwhile, since the filler 46 employs a material having relatively high elasticity, it contributes to protecting the motor drive circuit 41 against an impact from the outside. In addition, the filler 46 elastically deforms to cancel a dimensional tolerance so that the motor drive circuit 41 is in firmly contact with the cover member 38. This leads to improvement in heat radiation performance of the motor drive circuit 41 to the cover member 38.

The short electrical components, such as the switching device 44A, are mounted on the surface 43*a* on the near side relative to the central axis L of the motor compressor 10 and are arranged closer to the central axis L. In addition, the tall electrical components, such as the electrolytic condenser 44B and the transformer 44C, are arranged on the surface 43*a* of the substrate 43 and are arranged farther from the central axis L. This arrangement allows the electrical components on the surface 43*a* to line the cylindrical surface R of the circumferential surface 23. The accommodating portion 36 on the compressor housing 11 defines the accommodating space 35 for accommodating the motor drive circuit 41 in such a manner that the accommodating space 35 is formed along the cylindrical surface R of the circumferential wall 23.

Accordingly, in the motor drive circuit 41 accommodated in the accommodating space 35, the electrical components on the surface 43*a* of the substrate 43 line the cylindrical surface R of the circumferential wall 23. Since the electrical components line the cylindrical surface R, the motor drive circuit 41 is arranged relatively close to the central axis L of the compressor housing 11. Thus, the protrusion of the motor drive circuit 41 from the compressor housing 11 is controlled at a relatively small amount so that the motor compressor 10 becomes small in diameter.

The present invention is not limited to the embodiments described above but may be modified into the following alternative embodiments.

Figure 4:
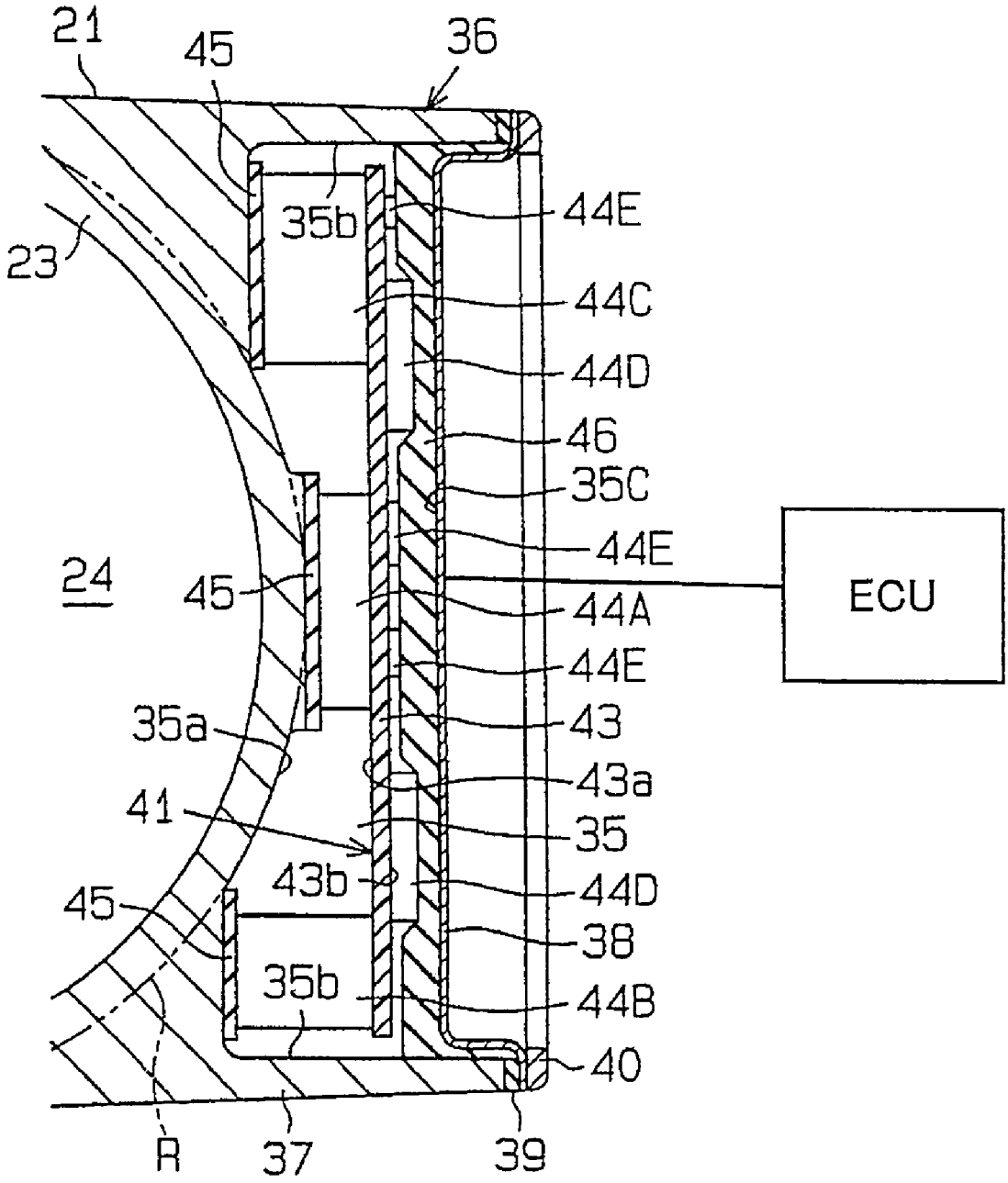
FIG. 4 is a partially enlarged cross-sectional view of a motor compressor according to an alternative embodiment of the present invention.

In alternative embodiments to the above preferred embodiment, referring to FIG. 4, a diagram illustrates a partially enlarged cross-sectional view of a motor compressor. The side wall 37 extends to a higher position than the motor drive circuit 41. That is, the side wall 37 is positioned on the right side relative to the motor drive circuit 41 in the drawing. In this manner, the side wall 37 of the compressor housing 11 having relatively high rigidity completely surrounds the side of the motor drive circuit 41 so that it effectively protects the motor drive circuit 41 against an impact from the outside.

In alternative embodiments to the above preferred embodiment, a motor compressor includes an electric motor and a compression mechanism that are independent to each other. In this state, a motor drive circuit is mounted on a compressor housing that exclusively accommodates the compression mechanism.

In alternative embodiments to the above preferred embodiment, an electric motor and a compression mechanism are respectively accommodated in different compressor housings in a motor compressor. In this state, a motor drive circuit is arranged in one of the compressor housing that accommodates the electric motor and the other that accommodates the compression mechanism.

In alternative embodiments to the above preferred embodiment, the motor compressor is a hybrid compressor that includes two drive sources for driving the compression mechanism 26. The two drive sources are an electric motor and an engine for driving a vehicle.

In alternative embodiments to the above preferred embodiment, the compression mechanism 26 is not limited to a scroll type. For example, a piston type, a vane type and a helical type are applicable.

Therefore, the present examples and embodiments are to be considered as illustrative and not restrictive, and the invention is not to be limited to the details given herein but may be modified within the scope of the appended claims.

What is claimed is:

1. An electric compressor comprising:

a compressor housing having a central axis and including a circumferential wall around the central axis and side walls projected from the circumferential wall;

a compression mechanism arranged in the compressor housing for compressing fluid;

an electric motor operatively connected to the compression mechanism for driving the compression mechanism;

an accommodating portion integrally formed on an outer surface of the compressor housing at least partially with the projected side walls, the accommodating portion defining an accommodating space, an inner surface of the accommodating space including a bottom surface and a side surface, the bottom surface being defined as a radially inward surface of the inner surface proximal to the central axis, the side surface surrounding a periphery of the bottom surface, and a motor drive circuit arranged in the accommodating space for driving the electric motor, wherein the motor drive circuit includes:

a substrate arranged on the circumferential wall;

a plurality of electrical components mounted on the substrate on the side proximal to the central axis, the electrical components including short electrical components having relatively short height from the substrate and tall electrical components having relatively tall height from the substrate, wherein the electrical components line the bottom surface of the accommodating space in such a manner that the short and tall electrical components are respectively arranged on the substrate on the proximal and peripheral portions relative to the central axis.

2. The electric compressor according to claim 1, further comprising:

an electrical insulating member interposed between the bottom surface and the motor drive circuit.

3. The electric compressor according to claim 1, wherein the compressor housing includes a frame-shaped side wall that extends from the circumferential wall to a distal end thereof, the side wall defining the side surface of the accommodating space, the accommodating portion including a cover member that is fixedly connected to the distal end of the side wall to cover an opening of the side wall, the cover member defining a top surface of the accommodating space.

4. The electric compressor according to claim 3, wherein the top surface is positioned above the distal end of the side wall relative to the bottom surface.

5. The electric compressor according to claim 3, wherein the distal end of the side wall is positioned above the motor drive circuit relative to the bottom surface.

6. The electric compressor according to claim 3, wherein the top surface is positioned below the distal end of the side wall relative to the bottom surface.

7. The electric compressor according to claim 3, wherein the cover member is made of metal, the compressor further comprising:

an electrical insulating member interposed between the top surface of the accommodating space and the motor drive circuit.

8. The electric compressor according to claim 1, wherein the circumferential wall has a substantially cylindrical surface, wherein the electrical components line the cylindrical surface of the circumferential wall.

9. The electric compressor according to claim 8, wherein the accommodating space is formed along the cylindrical surface of the circumferential wall.

10. The electric compressor according to claim 1, wherein the compression mechanism is a scroll type.

11. A compressor driven by an electric motor, the electric motor being driven by a motor drive circuit, the compressor comprising:

a housing having a central axis and including a circumferential wall around the central axis, the housing partially defining an accommodating space on the circumferential wall for accommodating the motor drive circuit, the circumferential wall having a substantially cylindrical surface, an inner surface of the accommodating space including bottom and side surfaces, the bottom surface partially including the substantially cylindrical surface, the side surface surrounding a periphery of the bottom surface; and a compression mechanism arranged in the housing for compressing fluid.

12. The compressor according to claim 11, further comprising:

an electrical insulating member interposed between the bottom surface and the motor drive circuit.

13. The compressor according to claim 11, wherein the housing includes a frame-shaped side wall that extends from the circumferential wall to a distal end thereof, the side wall defining the side surface of the accommodating space, the compressor further comprising:

a cover member cover member fixedly connected to the distal end of the side wall to cover an opening of the side wall, the cover member defining a top surface of the accommodating space.

14. The compressor according to claim 13, wherein the distal end of the side wall is positioned above the motor drive circuit relative to the bottom surface.

15. The compressor according to claim 13, wherein the cover member is made of metal, the compressor further comprising:

an electrical insulating member interposed between the top surface of the accommodating space and the motor drive circuit.

16. The compressor according to claim 11, wherein the motor drive circuit includes:

a substrate arranged in the accommodating space;

a plurality of electrical components mounted on the substrate on the near side relative to the central axis, the electrical components including short electrical components having relatively short height from the substrate and tall electrical components having relatively tall height from the substrate, wherein the electrical components line the substantially cylindrical surface of the circumferential wall in such a manner that the short and tall electrical components are respectively arranged on the substrate on the near and far portions relative to the central axis.

17. A compressor housing for arranging an electrical circuit thereon, the compressor housing comprising:

a circumferential wall having a substantially cylindrical surface; and at least a part of accommodating portion provided on a circumferential wall of the compressor housing for accommodating the electrical circuit, the part of accommodating portion at least partially defining an accommodating space, an inner surface of the accommodating space including bottom and side surfaces, the bottom surface at least partially including the substantially cylindrical surface, the side surface surrounding a periphery of the bottom surface and extending from the circumferential wall of the compressor housing.

18. The compressor housing according to claim 17, wherein the part of accommodating portion includes a frame-shaped side wall that extends from the circumferential wall of the compressor housing to a distal end thereof, the side wall defining the side surface of the accommodating space.

19. The compressor housing according to claim 18, wherein the distal end of the side wall is positioned above the electrical circuit relative to the bottom surface.

* * * * *